US008718500B2

(12) United States Patent
Minbu et al.

(10) Patent No.: US 8,718,500 B2
(45) Date of Patent: May 6, 2014

(54) IMAGE FORMING APPARATUS

(75) Inventors: Ryuichi Minbu, Ebina (JP); Kenji Sengoku, Kawasaki (JP); Junpei Fujita, Sagamihara (JP); Osamu Ichihashi, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 906 days.

(21) Appl. No.: 12/708,983

(22) Filed: Feb. 19, 2010

(65) Prior Publication Data

US 2010/0221029 A1 Sep. 2, 2010

(30) Foreign Application Priority Data

Mar. 2, 2009 (JP) ..... 2009-047866

(51) Int. Cl.
*G03G 15/16* (2006.01)

(52) U.S. Cl.
USPC ..... 399/66

(58) Field of Classification Search
USPC ..... 399/66, 302, 308
See application file for complete search history.

(56) References Cited

U.S. PATENT DOCUMENTS

| | | | | |
|---|---|---|---|---|
| 4,910,558 | A * | 3/1990 | Giezeman et al. | 399/308 |
| 6,697,595 | B2 | 2/2004 | Kawagoe et al. | |
| 6,901,234 | B2 | 5/2005 | Ogiyama et al. | |
| 7,233,761 | B2 | 6/2007 | Kawagoe | |
| 7,346,287 | B2 | 3/2008 | Ogiyama et al. | |
| 7,502,583 | B2 | 3/2009 | Sawai et al. | |
| 8,165,498 | B2 * | 4/2012 | Hoshino et al. | 399/121 |
| 2003/0118359 | A1 | 6/2003 | Ogiyama et al. | |
| 2007/0258737 | A1 | 11/2007 | Ogiyama et al. | |
| 2007/0269230 | A1 | 11/2007 | Hoshino et al. | |
| 2008/0124155 | A1 | 5/2008 | Mimbu | |
| 2008/0232867 | A1 | 9/2008 | Minbu et al. | |
| 2009/0060611 | A1 | 3/2009 | Minbu | |
| 2009/0142083 | A1 | 6/2009 | Minbu | |

FOREIGN PATENT DOCUMENTS

| | | | |
|---|---|---|---|
| JP | 4-242276 | | 8/1992 |
| JP | 06018999 | A * | 1/1994 |
| JP | 10-83124 | | 3/1998 |
| JP | 2008-40328 | | 2/2008 |
| JP | 2008-175983 | | 7/2008 |
| JP | 2008-299247 | | 12/2008 |
| JP | 2010-134142 | | 6/2010 |

* cited by examiner

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

To provide an image forming apparatus capable of increasing the life of a rotating cam while preventing the occurrence of a shock jitter and transfer failure. The image forming apparatus is configured to execute a forced movement process for rotating the rotating cam to forcibly move a secondary transfer roller against a biasing force of a bias coil spring at a pre-entry timing prior to the entry of the front edge of a recording sheet into a secondary transfer position, and a pressure intensifying process for rotating the rotating cam to increase transfer pressure at a timing immediately after the entry of the front edge of the recording sheet into the secondary transfer position. As the forced movement process, the image forming apparatus executes, alternately, a first forced movement process for normally driving and rotating the rotating cam, and a second forced movement process for inversely driving and rotating the rotating cam, at a predetermined timing.

14 Claims, 10 Drawing Sheets

IMAGE FORMING APPARATUS

BACKGROUND OF THE INVENTION

1. Field of the Invention

The present invention relates to an image forming apparatus that has a function of forcibly moving an abutting body away from an image carrier by driving a rotating cam, the abutting body being capable of abutting the image carrier by means of a biasing force of a biasing part to form a transfer nip.

2. Description of the Related Art

Use of a thick sheet as a recording sheet in this type of image forming apparatus often causes a linear unevenness in the density of the image, which is called "shock jitter." When the thick sheet enters a transfer nip, the burden on an image carrier drastically increases and the linear speed of the image carrier is significantly reduced instantly, causing this density unevenness.

The image forming apparatus described in Japanese Patent Application Laid-open No. H10-83124 inhibits the occurrence of the shock jitter as follows. In this image forming apparatus, a transfer roller functioning as an abutting body has a cylindrical roller part, and a shaft member that projects from each end surface of the roller part to rotate integrally with the roller part. The shaft member on each end surface is provided with a rotating cam spinnably. These rotating cams are directly coupled to a motor for spinning the rotating cams on circumferential surfaces of the shaft members. The rotating cams that are spun on the circumferential surfaces of the shaft members by the motor have convex parts thereof brought into abutment with an end part of a photoreceptor, the image carrier, in its shaft direction at a predetermined rotational angle position. This abutment forcibly moves the transfer roller, which is biased toward the photoreceptor by a spring, away from the photoreceptor against a biasing force, so that the inter-shaft distance between the photoreceptor and the transfer roller can be increased. When a thick sheet is used as a recording sheet, the abovementioned inter-shaft distance is increased to reduce the nip pressure by forcibly moving the transfer roller or the transfer roller is separated from the photoreceptor. In this manner, the occurrence of the shock jitter can be inhibited by preventing a drastic increase in the burden on the photoreceptor, which occurs at the time of entry of a thick sheet. However, the increase of the abovementioned inter-shaft distance might cause a transfer failure due to a lack of transfer pressure.

The image forming apparatus described in Japanese Patent Application Laid-open No. H6-274051 is known as an image forming apparatus capable of avoiding the occurrence of such transfer failure. In this image forming apparatus, prior to the entry of a thick sheet into a transfer nip, a transfer roller is separated from a photoreceptor by driving a rotating cam, to form a tiny gap between the transfer roller and the photoreceptor. In this manner, the occurrence of the shock jitter is prevented. Next, immediately after allowing the thick sheet to enter the abovementioned tiny gap, the rotating cam is driven to release the forced movement of the transfer roller, and the transfer roller is pressed against the photoreceptor by taking advantage of the biasing force of the spring. As a result, sufficient transfer pressure can be exercised during the transfer process to prevent the generation of a transfer failure.

However, the problem of this configuration is that the convex parts of the rotating cams are worn out in a short period of time by frequently driving the rotating cam, significantly reducing the life of the rotating cams.

Technologies relating to the present invention are also disclosed in, e.g., Japanese Patent Application Laid-open No. H4-242276.

SUMMARY OF THE INVENTION

The present invention was contrived in view of the problems mentioned above, and it is an object of the present invention to provide an image forming apparatus that is capable of preventing the shock jitter and transfer failures and increasing the life of a rotating cam.

In an aspect of the present invention, an image forming apparatus comprises an image carrier that carries a visual image; an abutting body that is capable of abutting on the image carrier at a transfer position where the abutting body faces the image carrier, and forming a transfer nip; a transfer part that transfers to a recording sheet that enters the transfer position the visual image on the image carrier; a rotating cam that is disposed so as to be able to rotate both normally and inversely and has a convex part provided at a circumferential edge of the rotating cam and a small-diameter part that rotates on an orbit, the radius of which is smaller than that of the convex part; and a part to be abutted, which is provided to one of the image carrier and the abutting body or to an interlocking body interlocked with the image carrier or the abutting body, and which is brought into abutment with the rotating cam.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENT(S)

Hereinafter, an embodiment in which the present invention is applied to a tandem color copy machine (to be simply referred to as "copy machine" hereinbelow) is described.

Figure 1:
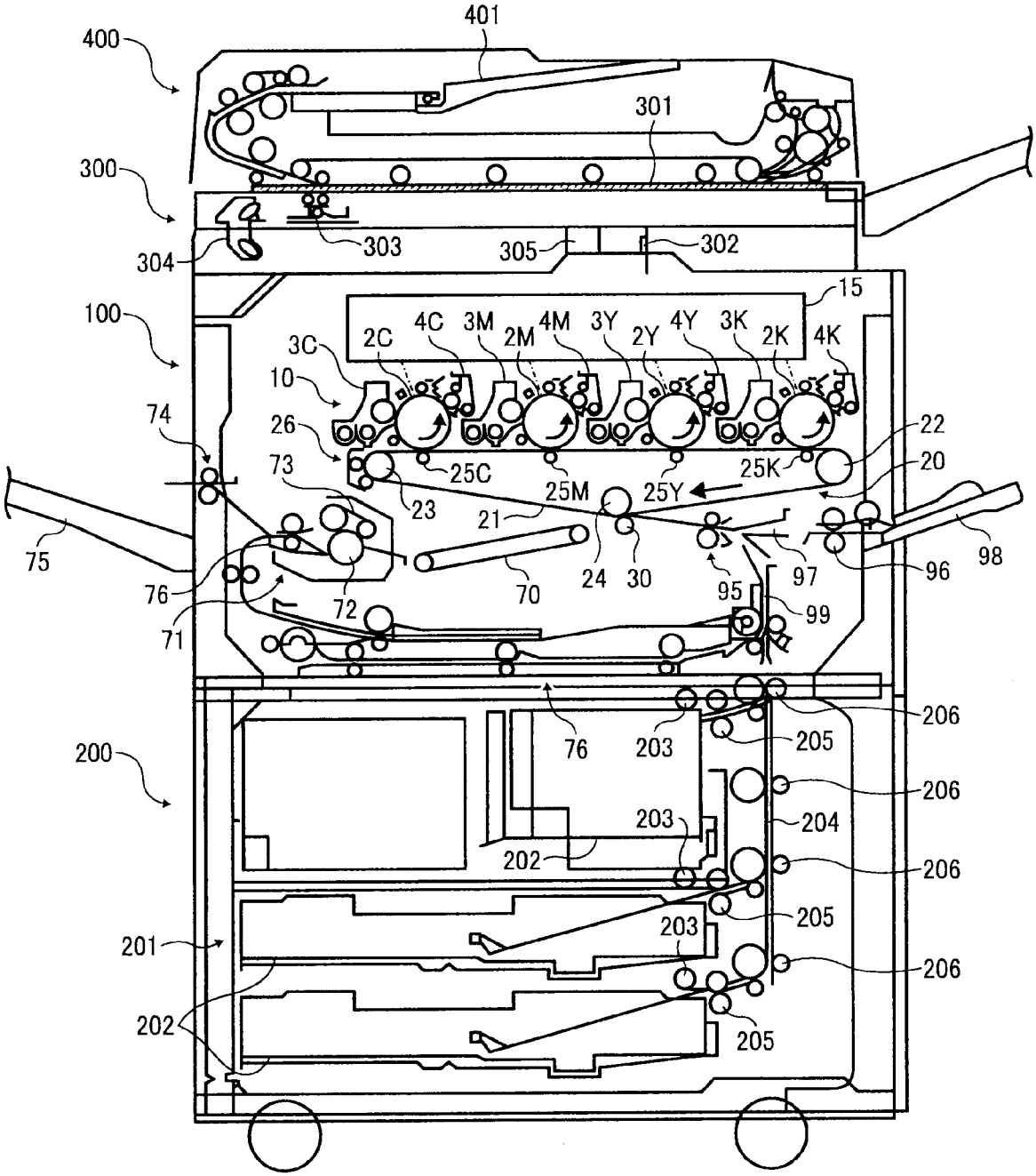
FIG. 1 shows a schematic configuration of a copy machine according to an embodiment of the present invention.

FIG. 1 shows a schematic configuration of the copy machine according to the present embodiment. This copy machine has a printer 100, sheet feeding part 200, scanner 300 attached to the top of the printer part 100, and automatic document feeder (ADF) 400 attached to the scanner 300.

The printer 100 has an endless belt-type intermediate transfer belt 21 as an image carrier. The intermediate transfer belt 21 is wrapped around a driving roller 22, driven roller 23 and secondary transfer counter roller 24 so as to form an inverted triangle as viewed from the side, and is moved endlessly in the clockwise direction by being driven by driving roller 22. Four image forming units 1C, M, Y and K for forming C (cyan), M (magenta), Y (yellow) and K (black) toner images are arranged above the intermediate transfer belt 21 along a belt moving direction.

The image forming units 1C, M, Y and K have photoreceptors 2C, M, Y and K, developing units 3C, M, Y and K, and photoreceptor cleaning devices 4C, M, Y and K, respectively. The photoreceptors 2C, M, Y and K are driven to rotate in the counterclockwise direction by driving means (not shown), while abutting on the intermediate transfer belt 21 to form C, M, Y and K primary transfer nips. Note that the developing units 3C, M, Y and K use C, M, Y and K toner to develop electrostatic latent images formed on the photoreceptors 2C, M, Y and K. The photoreceptor cleaning devices 4C, M, Y and K clean transfer residual toner adhering to the photoreceptors 2C, M, Y and K after the toner images pass through the primary transfer nips. In this printer, the four image forming units 1C, M, Y and K arranged along the belt moving direction configure a tandem image forming part 10.

In the printer 100, an optical writing unit 15 is disposed above the tandem image forming part 10. This optical writing unit 15 carries out an optical writing process by optically scanning the surfaces of the photoreceptors 2C, M, Y and K driven to rotate in the counterclockwise direction, and forms the electrostatic latent images. The surfaces of the photoreceptors 2C, M, Y and K are charged uniformly by uniform charging means of the image forming units 1C, M, Y and K before being subjected to the optical writing process.

A transfer unit 20 having the intermediate transfer belt 21 and the like has primary transfer rollers 25C, M, Y and k within the loop of the intermediate transfer belt 21. These primary transfer rollers 25C, M, Y and K press the intermediate transfer belt 21 against the photoreceptors 2C, M, Y and K at the back of the C, M, Y and K primary transfer nips.

A secondary transfer roller 30 functioning as an abutting body is disposed below the intermediate transfer belt 21. This secondary transfer roller 30 forms a secondary transfer nip by abutting on the secondary transfer counter roller 24 via the intermediate transfer belt 21, with the front surface of the belt facing secondary transfer roller 30. A recording sheet is sent to this secondary transfer nip at a predetermined timing. Then, a four-color superimposed toner image on the intermediate transfer belt 21 is secondarily transferred at once to the recording sheet at this secondary transfer nip.

The scanner 300 uses a reading sensor 302 to read image information on an original document placed on a contact glass 31, and sends the image information to a controller of the printer 100. The controller (not shown) that functions as control means configured by a CPU (Central Processing Unit), RAM (Random Access Memory) and ROM (Read Only Memory) controls a laser diode, LED, or other light source of the optical writing unit 15 of the printer 100 on the basis of the image information read by the scanner 300, and emits C, M, Y and K laser writing light beams to optically scan the photoreceptors 2C, M, Y and K. This optical scanning forms the electrostatic latent images on the surfaces of the photoreceptors 2C, M, Y and K. These latent images are developed to the C, M, Y and K toner images through a predetermined developing process.

The sheet feeding part 200 has sheet feeding cassettes 202 arranged in a multistage manner in a paper bank 201, sheet feeding rollers 203 for sending out recording sheets from the sheet feeding cassettes 202, separating rollers 205 for separating the sent recording sheets and guiding each recording sheet to a sheet feeding path 204, and conveying rollers 206 for conveying the recording sheets to a sheet feeding path 99 of the printer 100.

Feeding sheets can be performed by not only the sheet feeding part 200 but also a manual sheet feeding method. Therefore, the sheet feeding part 200 is also provided with a manual tray 98 and separating rollers 96 for separating the recording sheets on the manual tray 98 one by one and sending each recording sheet to a manual sheet feeding path 97. The manual sheet feeding path 97 joins the sheet feeding path 99 in the printer 100.

A resist roller pair 95 is disposed in the vicinity of a tail end of the sheet feeding path 99. The resist roller pair 95 sandwiches each of the recording sheets conveyed through the sheet feeding path 99, and thereafter sends out each recording sheet toward the secondary transfer nip at a predetermined timing.

When making a copy of a color image using this copy machine of the present embodiment, an original document is set on an original document table 401 of the ADF 400 or on the contact glass 301 of the scanner 300 by opening the ADF 400, and then the original document is pressed by closing the ADF 400. Thereafter, a start switch (not shown) is pressed. When the original document is set in the ADF 400, the original document is conveyed onto the contact glass 301. Subsequently, the scanner 300 starts driving, and a first traveling body 303 and second traveling body 304 starts traveling along the surface of the original document. A light beam of a light source of the first traveling body 303 is emitted to the surface of the original document, and the obtained reflected light is returned toward the second traveling body 304. The returned light is further returned by a mirror of the second traveling body 304 and then enters the reading sensor 302 through an imaging lens 305. The contents of the original document are read in this manner.

Once the image information is read from the scanner 300, the printer 100 feeds a recording sheet of a size corresponding to the image information to the sheet feeding path 99. Consequently, the driving roller 22 is driven to rotate by a driving motor (not shown), to endlessly move the intermediate transfer belt 21 in the clockwise direction. At the same time, the rotary drive of the photoreceptors 2C, M, Y and K of the image forming units 1C, M, Y and K is started, and then a uniform charging process, optical writing process, and developing process are carried out on the photoreceptors 2C, M, Y and K. The C, M, Y and K toner images are formed on the surfaces of the photoreceptors 2C, M, Y and K as a result of these processes. These toner images are sequentially superimposed at the C, M, Y and K primary transfer nips and primarily transferred onto the intermediate transfer belt 21, whereby the four-color superimposed toner image is obtained.

In the sheet feeding part 200, one of the sheet feeding rollers 203 is rotated selectively in accordance with the size of each recording sheet, and the recording sheets are sent out from one of the three sheet feeding cassettes 202. The sent recording sheets are separated one by one by the separating rollers 205 and introduced to the sheet feeding path 204. Thereafter, the separated recording sheet is sent to the sheet feeding path 99 of the printer 100 via the conveying rollers 206. When using the manual tray 98, a sheet feeding roller of the tray is driven to rotate, and the recording sheets on the tray are sent to the manual sheet feeding path 97 while being separated by the separating rollers 96, and finally reach the vicinity of the tail end of the sheet feeding path 99. In the vicinity of the tail end of the sheet feeding path 99, the front edge of the recording sheet abuts on and stops at the resist roller pair 95. When the resist roller pair 95 is subsequently driven to rotate in synchronization with the four-color superimposed toner image on the intermediate transfer belt 21, the recording sheet is sent to the secondary transfer nip and comes into tight contact with the four-color superimposed toner image. The four-color superimposed toner image is then secondarily transferred at once onto the recording sheet due to the effect of nip pressure or a transfer electric field.

The recording sheet to which the four-color superimposed toner image is secondarily transferred at the secondary transfer nip is sent into a fixing device 71 by a sheet conveying belt 70. The recording sheet is then sandwiched by a fixing nip between a pressure roller 72 and a fixing belt 73 in the fixing device 71 so that the four-color superimposed toner image is fixed to the surface of the recording sheet by pressurization or by a heating process. The recording sheet on which a color image is formed in this manner is stacked on a catch tray 75 outside the copy machine, via a discharge roller pair 74. Note that when forming an image on the other side of the recording sheet, the direction of the recording sheet is changed by a switching pawl 76 after the recording sheet is discharged from the fixing device 71, and consequently the recording sheet is sent to a sheet inverting device. After the recording sheet is inverted, the inverted recording sheet is sent back to the resist roller pair 95 and passes through the secondary transfer nip and the fixing device 71 again.

A belt cleaning device 26 abuts on the surface of the intermediate transfer belt 21 after the recording sheet passes through the secondary transfer nip and before a primary transfer step starts at the C primary transfer nip, which is the uppermost stream in the four colors. This belt cleaning device 26 cleans the transfer residual toner adhering to the belt surface.

Figure 2:
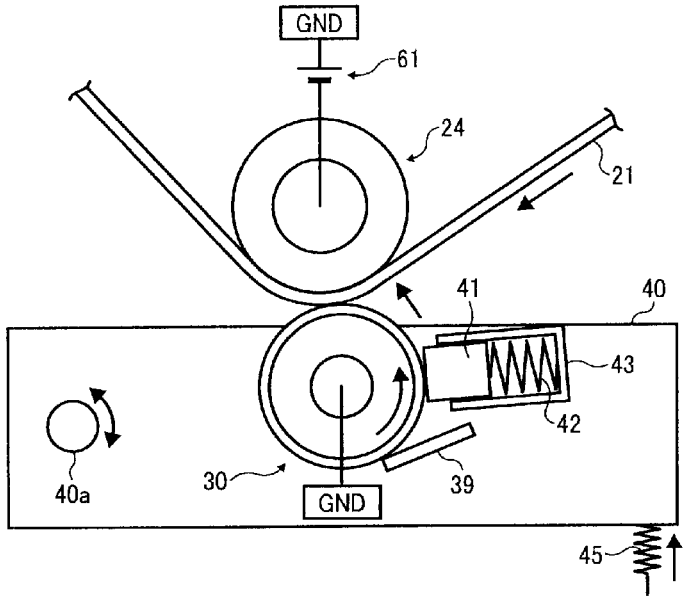
FIG. 2 is a schematic diagram showing a secondary transfer nip and its peripheral configuration in a printer of the copy machine.

FIG. 2 shows the secondary transfer nip and its peripheral configuration in the printer 100 of the copy machine according to the present embodiment. In this diagram, the secondary transfer counter roller 24 wrapped partially by the intermediate transfer belt 21 in the loop thereof serves to back up the deformable intermediate transfer belt 21 by using the circumferential surface of the secondary transfer counter roller 24 so that the intermediate transfer belt 21 is kept in the shape corresponding to a certain curvature. In the section where the secondary transfer counter roller 24 is wrapped by the intermediate transfer belt 21, the secondary transfer roller 30 abuts thereon from the belt front surface side, whereby the secondary transfer nip is formed therebetween.

The secondary transfer roller 30 is held rotatably by a roller unit holding body 40 via a bearing (not shown). The roller unit holding body 40 is capable of revolving about a revolving shaft 40*a* disposed parallel to a rotation shaft line of the secondary transfer roller 30. When the roller unit holding body 40 rotates around the revolving shaft 40*a* in the counterclockwise direction, the secondary transfer roller 30 held by the roller unit holding body 40 is pressed against the intermediate transfer belt 21, whereby the secondary transfer nip is formed. Furthermore, when the roller unit holding body 40 rotates around the revolving shaft 40*a* in the clockwise direction, the secondary transfer roller 30 held by the roller unit holding body 40 separates from the intermediate transfer belt 21. In the copy machine according to the present embodiment, an end part of the roller unit holding body 40, which is located on the other side of the revolving shaft 40*a*, is always biased toward the intermediate transfer belt 21 by a bias coil spring 45 functioning as biasing means biases. The bias coil spring 45 biases the secondary transfer roller 30 toward the intermediate transfer belt 21 by constantly providing a force of rotating the roller unit holding body 40 around the revolving shaft 40*a* in the counterclockwise direction.

A rotary drive force of a roller driving motor (not shown) is transmitted to the secondary transfer roller 30 via a gear or other drive transmission means (not shown) to drive and rotate the secondary transfer roller 30 in the counterclockwise direction. The roller driving motor and the drive transmission means are also held by the roller unit holding body 40 and caused to revolve along with the secondary transfer roller 30 and the roller unit holding body 40. The roller unit holding body 40 also holds a cleaning blade 39, a solid lubricant 41, a lubricant pushing container 43 and the like.

The toner on the intermediate transfer belt 21 carrying the toner images adheres to the surface of the secondary transfer roller 30 that is in contact with the front surface of the belt. If this adhering toner is left as it is, the adhering toner is transmitted to the back of the recording sheet at the secondary transfer nip, causing so-called back staining. In the present copy machine, therefore, the edge of the cleaning blade 39 is brought into abutment with the surface of the secondary transfer roller 30 to mechanically remove the toner from the surface of the secondary transfer roller 30. In this configuration, because such abutment of the cleaning blade 39 imposes a burden that prevents the secondary transfer roller 30 from rotating, the secondary transfer roller 30 cannot be driven to rotate following the rotation of intermediate transfer belt 21. For this reason, the secondary transfer roller 30 is driven to rotate by means of the abovementioned roller driving motor.

The lubricant pushing container 43 applies lubricant powder to the secondary transfer roller 30 by pressing the solid lubricant 41 made from zinc stearate against the secondary transfer roller 30 by means of the bias coli spring 42. By applying the lubricant in this manner, the rotation burden caused by the abutment between the cleaning blade 39 and the secondary transfer roller 30 is prevented from increasing. In addition, the blade edge is prevented from being caught into the roller. Instead of pressing the solid lubricant 41 against the secondary transfer roller 30, a rotating application brush for scraping the lubricant off the solid lubricant 41 and applying it to the secondary transfer roller 30 may be provided.

Figure 3:
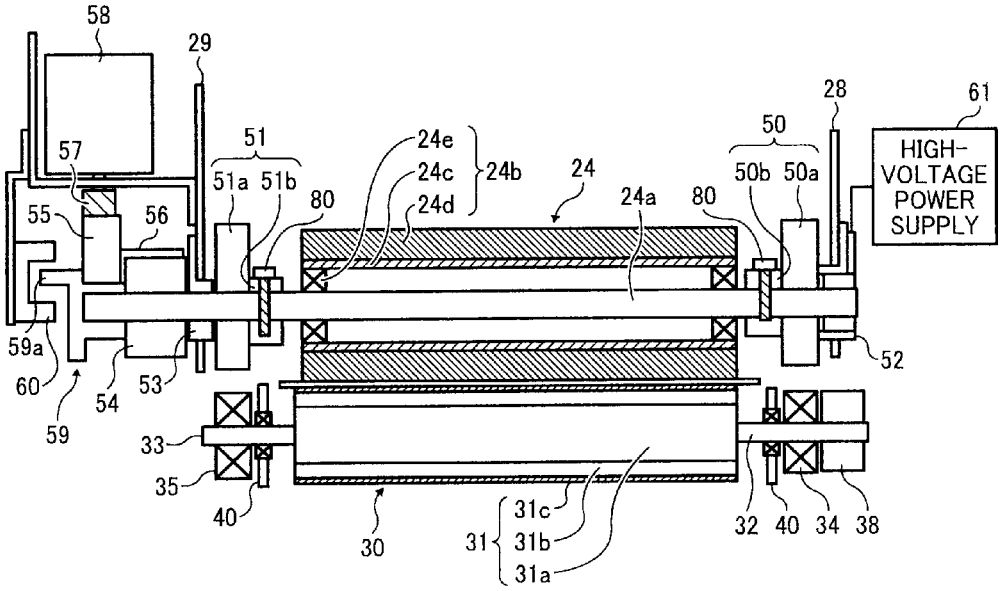
FIG. 3 is a cross-sectional view showing the peripheral configuration of the secondary transfer nip.
Figure 4:
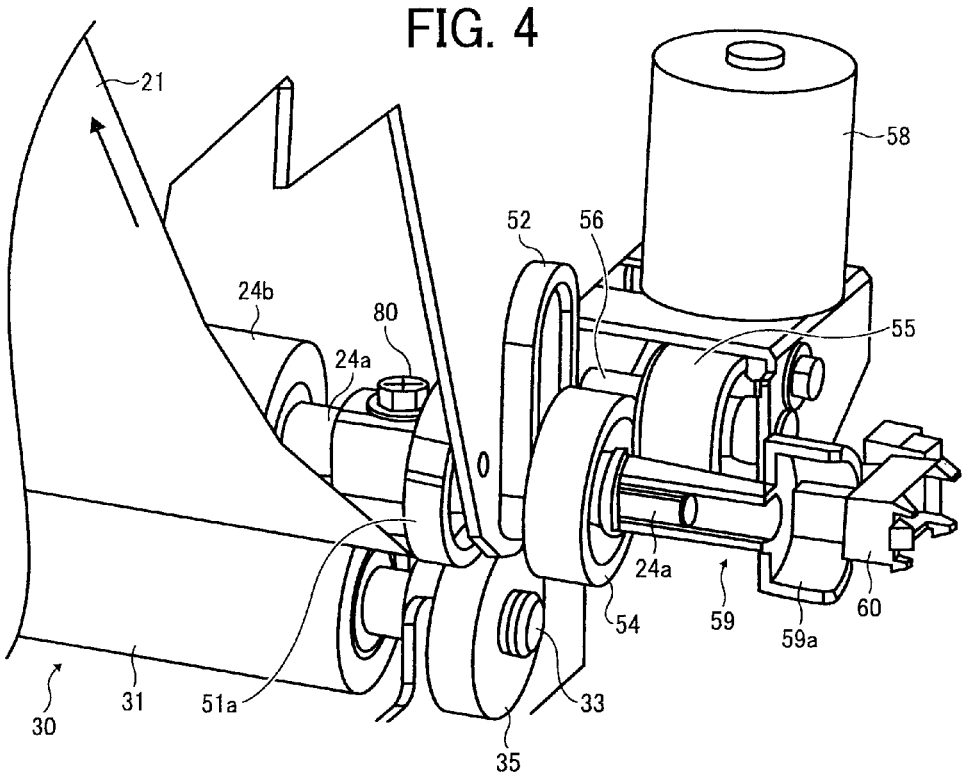
FIG. 4 is a perspective view showing the peripheral configuration.

FIG. 3 shows the peripheral configuration of the secondary transfer nip. FIG. 4 also shows the peripheral configuration of the secondary transfer nip.

In these diagrams, the secondary transfer roller 30 has a roller part 31, first and second shaft members 32 and 33 that project from the ends of the roller part 31 in its shaft line respectively and extend in the rotation shaft line direction, and first and second spinning rollers 34 and 35 described hereinafter. The roller part 31 also has a cylindrical hollow cored bar 31*a*, an elastic layer 31*b* of an elastic material, which is fixed to the circumferential surface of the hollow cored bar 31*a*, and a surface layer 31*c* fixed to the circumferential surface of the elastic layer 31*b*.

Examples of the metal composing the hollow cored bar 31*a* include, but are not limited to, stainless and aluminum. The elastic layer 31*b* desirably has a JIS-A hardness of 70[°] or lower. However, because the cleaning blade 39 is brought into abutment with the roller part 31, various problems occurs if the elastic layer 31*b* is excessively soft. Therefore, it is desired that the elastic layer 31*b* have a JIS-A hardness of at least 40[°]. The elastic layer 31*b* having a JIS-A hardness of approximately 50[°] is formed by an epichlorohydrin rubber that exhibits a certain degree of electrical conductivity. In place of this electrically conductive epichlorohydrin rubber, EPDM or Si rubber in which carbon is dispersed, NBR with an ionic conductivity function, urethane rubber or the like may be used as a rubber material exhibiting electrical conductivity. Because most rubber materials exhibit good chemoaffinity to toner or exhibit a relatively large friction coefficient, the surface of the rubber elastic layer 31*b* is coated with the surface layer 31*c*. In this manner, the toner is prevented from adhering to the surface of the roller part 31, and the burden caused by rubbing the blade on the roller part 31 is alleviated. As the material of the surface layer 31*c*, a fluorine resin based resin containing carbon, ion conductive agent or other resistance adjustment agent, which has a log friction coefficient and exhibits good toner releasability, is suitably used.

When rotating in contact with the intermediate transfer belt 21, the secondary transfer roller 30 provides a minute linear speed difference with the belt. The friction coefficient of the surface layer 31*c* is adjusted to 0.3 or lower so that the belt does not slip due to this linear speed difference. In order to superimpose images of different colors and transfer thus obtained superimposed image without causing color shift, the intermediate transfer belt 21 needs to be driven at constant speed. Hence, it is important to reduce the surface friction resistance of the surface layer 31*c* of the secondary transfer roller 30.

The secondary transfer roller 30 is biased toward the intermediate transfer belt 21 wrapped around the secondary transfer counter roller 24. The secondary transfer counter roller 24 wrapped by the intermediate transfer belt 21 has a roller part 24*b*, which is a cylindrical main body part, and a penetrating shaft member 24*a* that penetrates a rotation central section of the roller part 24*b* and spins the roller part 24*b* on the surface of the penetrating shaft member 24*a*. The penetrating shaft member 24*a* made from metal freely spins the roller part 24*b* on the circumferential surface of the penetrating shaft member 24*a*. The roller part 24*b* functioning as the main body part has a drum-like hollow cored bar 24*c*, an elastic layer 24*d* of an elastic material, which is fixed to the circumferential surface of the hollow cored bar 24*c*, and a ball bearing 24*e* that is press-fitted to each end of the hollow cored bar 24*c* in its shaft line direction. The ball bearing 24*e* rotates on the penetrating shaft member 24*a* along with the hollow cored bar 24*c* while supporting the hollow cored bar 24*c*. The elastic layer 24*d* is press-fitted to the outer circumferential surface of the hollow cored bar 24*c*.

The penetrating shaft member 24*a* is rotatably supported by a first bearing 52, which is fixed to a first side plate 28 of the transfer unit that tightly stretches the intermediate transfer belt 21, and a second ball bearing 53 fixed to a second side plate. However, most of the time during a print job, the penetrating shaft member 24*a* is not driven to rotate but stopped. The penetrating shaft member 24*a* freely spins the roller part 24*b* on the circumferential surface of the penetrating shaft member 24*a*, the roller part 24*b* being dragged to the endless movement of the intermediate transfer belt 21.

The elastic layer 24*d* fixed to the circumferential surface of the hollow cored bar 24*c* is configured by an electrically conductive rubber material, the resistance value of which is adjusted by the addition of an ion conductive agent, so as to exhibit at least 7.5[Log Ω] resistance. The electric resistance of the elastic layer 24*d* is adjusted to a predetermined level in order to prevent transfer current from concentrating on a section of the secondary transfer nip where the belt and the roller are in direct contact without a recording sheet, such as A5-copy paper, therebetween, when the recording sheet used has a relatively small roller shaft line direction. By setting the electric resistance of the elastic layer 24*d* at a value larger than that of the resistance of the recording sheet, such concentration of the transfer current can be inhibited.

Moreover, as the electrically conductive rubber configuring an elastic layer 16*c*, a foamed rubber exhibiting elasticity at an Asker-C hardness of approximately 40[°] is used. By configuring the elastic layer 16*c* using the foamed rubber, the elastic layer 16*c* can be elastically deformed in its thickness direction in the secondary transfer nip, and the secondary transfer nip that is somewhat wide in a sheet conveying direction can be formed. In the present copy machine, as described above, it is difficult to use a highly elastic material as the material of the roller part of the secondary transfer roller 30, because the cleaning blade 39 is brought into abutment with the secondary transfer roller 30. Therefore, instead of elastically deforming the secondary transfer roller 30, the roller part 24*b* of the secondary transfer counter roller 24 is elastically deformed.

In the entire region in the longitudinal direction of the penetrating shaft member 24*a* of the secondary transfer counter roller 24, the regions of both end parts that are not located in the roller part 24*b* have rotating cams (50, 51) fixed to be able to rotate integrally with the penetrating shaft member 24*a*, the rotating cams abutting on the secondary transfer roller 30. Specifically, in the region of one of the end parts in the longitudinal direction of the penetrating shaft member 24*a*, the first rotating cam 50 is fixed. The first rotating cam 50 is formed integrally by arranging a rotating cam part 50*a* and a circular roller part 50*b* in the shaft line direction. A screw 80 penetrating the roller part 50*b* is threadably mounted on the penetrating shaft member 24*a* to fix the first rotating cam 50 to the penetrating shaft member 24*a*. On the other hand, the second rotating cam 51 having the same configuration as the first rotating cam 50 is fixed in the region of the other end part in the longitudinal direction of the penetrating shaft member 24*a*.

A drive receiving gear 54 is fixed in a region outside the second rotating cam 51 in the shaft line direction of the penetrating shaft member 24*a*. A disc 59 to be detected is fixed farther out of the drive receiving gear 54.

On the other hand, a cam driving motor 58 is fixed to the second side plate 29 of the transfer unit, and an input/output gear unit is also fixed rotatably to the same. This input/output gear unit is formed integrally by arranging, in the shaft line direction, an input gear part 55 that receives a drive force by meshing with a motor gear 57 of the cam driving motor 58, and an output gear part 56 that meshes with the drive receiving gear 54 fixed to the penetrating shaft member 24*a* to transmit the drive force. The penetrating shaft member 24*a* can be rotated by driving the cam driving motor 58. In so doing, because the roller part 24*b* can be freely spun on the penetrating shaft member 24*a* even when the penetrating shaft member 24*a* is rotated, the roller part 24*b* is not stopped from being dragged by the rotation of the belt.

When the penetrating shaft member 24*a* stops rotating at a predetermined rotational angle position, convex parts of the first and second rotating cams 50 and 51 abut on the secondary transfer roller 30, and consequently the secondary transfer roller 30 is pushed back again the biasing force of the bias coil spring (45) of the roller unit holding body. Accordingly, the secondary transfer roller 30 is moved away from the secondary transfer counter roller 24 (or from the intermediate transfer roller 21), whereby the inter-shaft distance between the secondary transfer counter roller 24 and the secondary transfer roller 30 is adjusted. According to this configuration, distance adjusting means for adjusting the inter-shaft distance between the secondary transfer counter roller 24 and the secondary transfer roller 30 is configured by the first rotating cam 50, the second rotating cam 51, the cam driving motor 58, various gears, and the abovementioned roller unit holding body. The secondary transfer counter roller 24 functioning as a rotatable support rotating body freely spins the roller part 24*b* on the penetrating shaft member 24*a* penetrating the cylindrical roller part 24*b*. Because the rotating cams (50, 51) fixed to the both end parts in the shaft line direction of the penetrating shaft member 24*a* are integrally rotated by rotating the penetrating shaft member 24*a*, these rotating cams at both ends can be rotated by simply providing one of the ends of the shaft line direction with a drive transmission mechanism for transmitting drive to the penetrating shaft member 24*a*. In this manner, compared to the prior art in which the drive transmission mechanism has to be provided to the both ends, the present invention can improve the degree of freedom in layout of the distance adjusting means.

In the present copy machine, while the hollow core bar 31*a* of the secondary transfer roller 30 is grounded, a secondary transfer bias having the same polarity as the toner is applied to the hollow cored bar 24*c* of the secondary transfer counter roller 24. Thus, a secondary transfer electric field that moves the toner from the secondary transfer counter roller 24 side toward the secondary transfer roller 30 side is formed between the rollers in the secondary transfer nip.

The first bearing 52 that rotatably receives the metallic penetrating shaft member 24*a* of the secondary transfer counter roller 30 is configured by an electrically conductive slide bearing. A high-voltage power supply 61 that outputs the secondary transfer bias is connected to this electrically conductive first bearing 52. The secondary transfer bias that is output from the high-voltage power supply 61 is guided to the secondary transfer counter roller 30 via the electrically conductive first bearing 52. In the secondary transfer counter roller 30, the secondary transfer bias is transmitted to the metallic penetrating shaft member 24*a*, the metallic ball bearing 24*e*, the metallic hollow cored bar 24*c* and the electrically conductive elastic layer 24*d* sequentially.

The disc 59 to be detected, which is fixed to one end of the penetrating shaft member 24*a*, has a part 59*a* to be detected, which rises in the shaft line direction at a predetermined position in the rotation direction of the penetrating shaft member 24*a*. On the other hand, an optical sensor 60 is fixed to a motor bracket supporting the cam driving motor 58. In the process for rotating the penetrating shaft member 24*a*, when the penetrating shaft member 24*a* comes to a predetermined rotational angle position, the part 59*a* to be detected in the disc 59 to be detected enters between a light-emitting element and light-receiving element of the optical sensor 60 and blocks the optical path therebetween. The light-receiving element of the optical sensor 60 receives light from the light-emitting element and transmits a light-receiving signal to the controller mentioned above. The controller understands the rotational angle positions of the convex parts of the rotating cams (50, 51) fixed to the penetrating shaft member 24*a*, based on the timing when the transmission of the light-receiving signals from the light-receiving element is discontinued and based on how much the cam driving motor 58 is driven from that timing.

As described above, the rotating cams (50, 51) abut on the secondary transfer roller 30 at predetermined rotational angle positions and push back the secondary transfer roller 30 away from the secondary transfer counter roller 24 against the biasing force of the bias coil spring (45) (this pushing back motion is referred to as "push-down" hereinafter). The push-back amount (to be referred to as push-down amount hereinafter) at this moment is determined based on how much the convex parts of the rotating cams (50, 51) project. Note that the larger the push-down amount of the secondary transfer roller 30 is, the longer the inter-shaft distance between the secondary transfer counter roller 24 and the secondary transfer roller 30.

In the secondary transfer roller 30, the first shaft member 32 that rotates integrally with the roller part 31 is provided with the first spinning roller 34 so as to be able to spin freely. This first spinning roller 34 has a slightly larger outer diameter than the roller part 31 and is in the shape of a doughnut disc. The first spin roller itself functions as a ball bearing and is capable of spin on the circumferential surface of the first shaft member 32. The second shaft member 33 of the secondary transfer roller 30 is provided with the second spinning roller 35 having the same configuration as the first spinning roller 34, the second spinning roller 35 being capable of spinning freely.

At a predetermined rotational angle position, the first rotating cam 50 fixed to one end of the penetrating shaft member 24*a* abuts on a roller surface (part to be abutted) of the first spinning roller 34 functioning as an interlocking body interlocked with the secondary transfer roller 30 in a spring biasing direction. At the same time, the second rotating cam 51 fixed to the other end of the penetrating shaft member 24*a* abuts on a roller surface (part to be abutted) of the second spinning roller 35 functioning as an interlocking body. The spinning rollers (34, 35) abutted by the rotating cams (50, 51) of the secondary transfer counter roller 24 are stopped from rotating due to this abutting motion, but the secondary transfer roller 30 is not prevented from rotating. Even when the spinning rollers (34, 35) stop rotating, the shaft members (32, 33) of the secondary transfer roller 30 can rotate freely and independently from the spinning rollers, because the spinning rollers function as ball bearings. By stopping the rotation of the spinning rollers (34, 35) as the rotating cams (50, 51) abut on the spinning rollers, not only is it possible to prevent the occurrence of friction between each rotating cam and each spinning roller, but also the torque of the belt driving motor or of the driving motor of the secondary transfer roller 30 can be prevented from increasing due to the friction.

The controller executes the following forced movement process. In other words, in this process, at a pre-entry timing, which is a pre-entry timing of the front edge of a recording sheet into the secondary transfer nip serving as a transfer position, the cam driving motor 58 is driven to rotate the rotating cams (50, 51) to a predetermined rotational angle position, and the secondary transfer roller 30 is forcibly moved away from the intermediate transfer belt 21. By this forced movement process, a drastic increase of the burden on the intermediate transfer belt 21, which occurs when the recording sheet enters the secondary transfer nip, can be prevented. In addition, the occurrence of a shock jitter can be prevented. Note that a timing of starting to send the recording sheet toward the secondary transfer nip by means of the resist roller pair 95 is adopted as the pre-entry timing.

The controller further executes the following pressure intensifying process. In other words, at a timing immediately after the entry of the front edge of the recording sheet into between the intermediate transfer belt 21 and the secondary transfer roller 30, the rotating cams (50, 51) are rotated to a rotational angle position different from the abovementioned predetermined rotational angle position. As a result, the transfer pressure on the recording sheet is increased. By this pressure intensifying process, the transfer pressure is made higher than the transfer pressure obtained at the pre-entry timing, whereby a sufficient transfer pressure can be obtained during the transfer process and the occurrence of a transfer failure can be prevented.

The forced movement process is carried out not only at the pre-entry timing mentioned above, but also at a timing immediately prior to the discharge of the recording sheet when the rear edge of the recording sheet slips out of the space between the intermediate transfer belt 21 and the secondary transfer roller 30. Carrying out the forced movement process at the timing immediately prior to the discharge can prevent a drastic decrease of the burden on the intermediate transfer belt 21 that occurs when the rear edge of the sheet slips out. Therefore, the occurrence of image density unevenness caused by the drastic burden decrease can be prevented. Note that the forced movement process carried out at the timing immediately prior to the discharge is particularly called "decompression process."

The characteristic configurations of the copy machine according to the present embodiment are described next.

Figure 5:
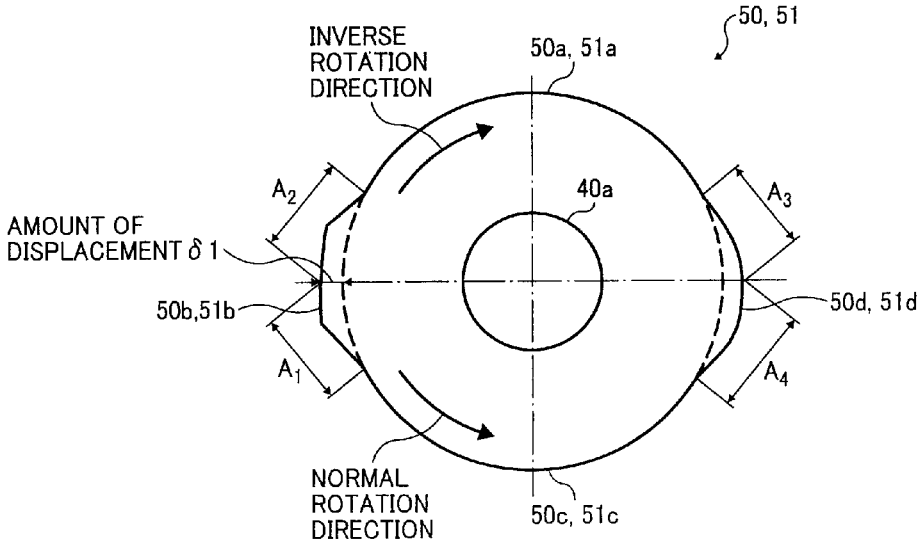
FIG. 5 is a side view showing the configurations of a first rotating cam and a second rotating cam of the copy machine.

FIG. 5 shows the first rotating cam 50 and the second rotating cam 51. The first rotating cam 50 and second rotating cam 51 have first small-diameter parts 50*a*, 51*a*, first convex parts 50*b*, 51*b*, second small-diameter parts 50*c*, 51*c*, and second convex parts 50*d*, 51*d*. The first small-diameter parts 50*a*, 51*a* and the second small-diameter parts 50*c*, 51*c* have the same diameter. The first convex parts 50*b*, 51*b* have a larger diameter than the first small-diameter parts 50*a*, 51*a* and the second small-diameter parts 50*c*, 51*c*. The second convex parts 50*d*, 51*d* have a larger diameter than the first small-diameter parts 50*a*, 51*a* and the second small-diameter parts 50*c*, 51*c* but have a smaller diameter than the first convex parts 50*b*, 51*b*. In this diagram, the first rotating cam 50 and the second rotating cam 51 are stopped at a rotational angle position of 0[°]. In this state, the first rotating cam 50 and the second rotating cam 51 are positioned such that the first small-diameter parts 50*a*, 51*a* are oriented in a vertical direction, as shown in the diagram.

In the present copy machine, when the cam driving motor 58 is driven to rotate normally, the first rotating cam 50 and the second rotating cam 51 are driven to rotate in the counterclockwise direction. Hereinafter, this direction is called "normal rotation direction" and the opposite direction is called "inverse rotation direction."

Focusing on the first convex parts 50*b*, 51*b* in the first rotating cam 50 and the second rotating cam 51, the second small-diameter parts 50*c*, 51*c* are adjacent thereto on the upstream side in the normal rotation direction. In other words, the second small-diameter parts 50*c*, 51*c* function as upstream side small-diameter parts in relation to the first convex parts 50*b*, 51*b*. On the other hand, because the second small-diameter parts 50*c*, 51*c* are adjacent to the second convex parts 50*d*, 51*d* on the downstream side in the normal rotation direction, the second small-diameter parts 50*c*, 51*c* function as downstream side small-diameter parts.

Focusing on the first convex parts 50*b*, 51*b* in the first rotating cam 50 and the second rotating cam 51, the first small-diameter parts 50*a*, 51*a* are adjacent thereto on the downstream side in the normal rotation direction. In other words, the first small-diameter parts 50*a*, 51*a* function as downstream side small-diameter parts in relation to the first convex parts 50*b*, 51*b*. On the other hand, because the first small-diameter parts 50*a*, 51*a* are adjacent to the second convex parts 50*d*, 51*d* on the upstream side in the normal rotation direction, the first small-diameter parts 50*a*, 51*a* function as the upstream side small-diameter parts.

Figure 6:
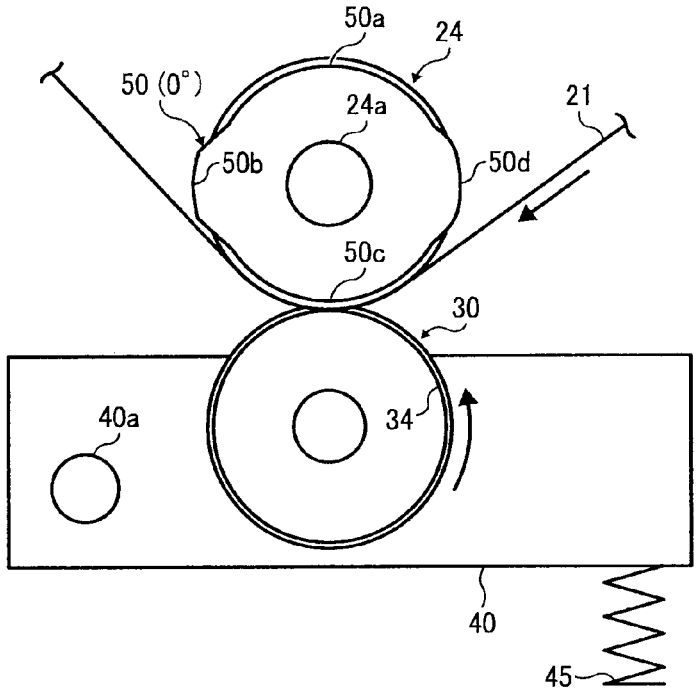
FIG. 6 is a diagram showing a peripheral configuration of a secondary transfer position in a condition in which the first rotating cam is stopped at a rotational angle position of 0[°]

FIG. 6 shows the periphery of the secondary transfer position in a condition in which the first rotating cam 50 is stopped at a rotational angle position of 0[°]. In this condition, the second small-diameter part 50*c* of the first rotating cam 50 is positioned to face the first spinning roller 34 on the shaft member of the secondary transfer roller 30, in a non-contact manner. In other words, the first rotating cam 50 does not push down (or forcibly move) the secondary transfer roller 30. The secondary transfer roller 30 is pressed against the intermediate transfer belt 21 by the biasing force of the bias coil spring 45, whereby the secondary transfer nip is formed. On the other side of the roller shaft line direction, the second small-diameter part (51*c*) of the second rotating cam (51) (not shown) faces the second spinning roller (35) similarly, and at the same time a predetermined gap is held therebetween. Hereinafter, since the behavior of the second rotating cam is the same as that of the first rotating cam 50, only the behavior of the first rotating cam 50 is described.

Figure 7:
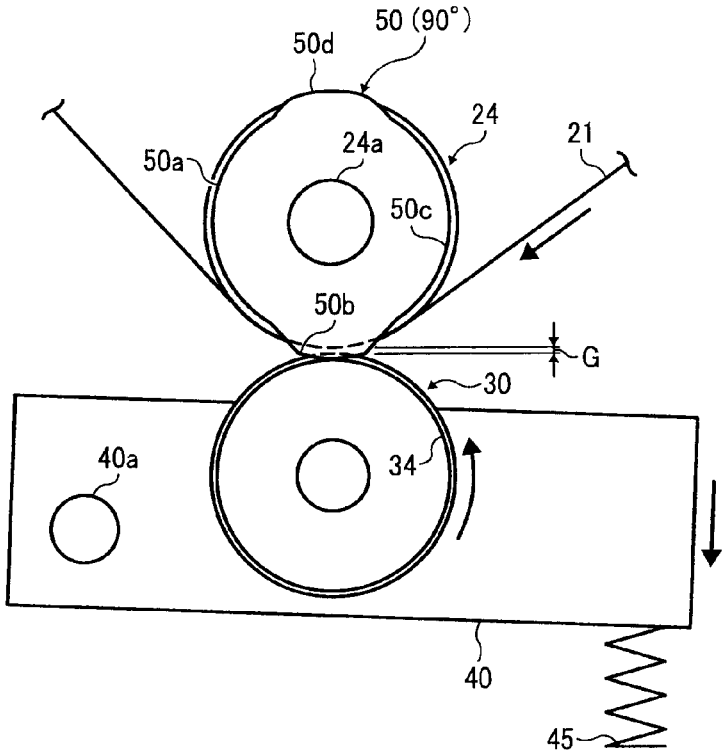
FIG. 7 is a diagram showing the peripheral configuration of the secondary transfer position in a condition in which the first rotating cam is stopped at a rotational angle position of 90[°]

FIG. 7 shows the periphery of the secondary transfer position in a condition in which the first rotating cam 50 is normally rotated by 90[°] from the condition shown in FIG. 6, that is, a condition in which the first rotating cam 50 is stopped at a rotational angle position of 90[°]. In this condition, the first rotating cam 50 causes the first convex part 50*b* to abut on the first spinning roller 34 on the shaft member of the secondary transfer roller 30 to push down the secondary transfer roller 30. When the secondary transfer roller 30 is pushed down by the first convex part 50*b*, a gap G is formed between the intermediate transfer belt 21 and the secondary transfer roller 30, as shown in the diagram.

Figure 8:
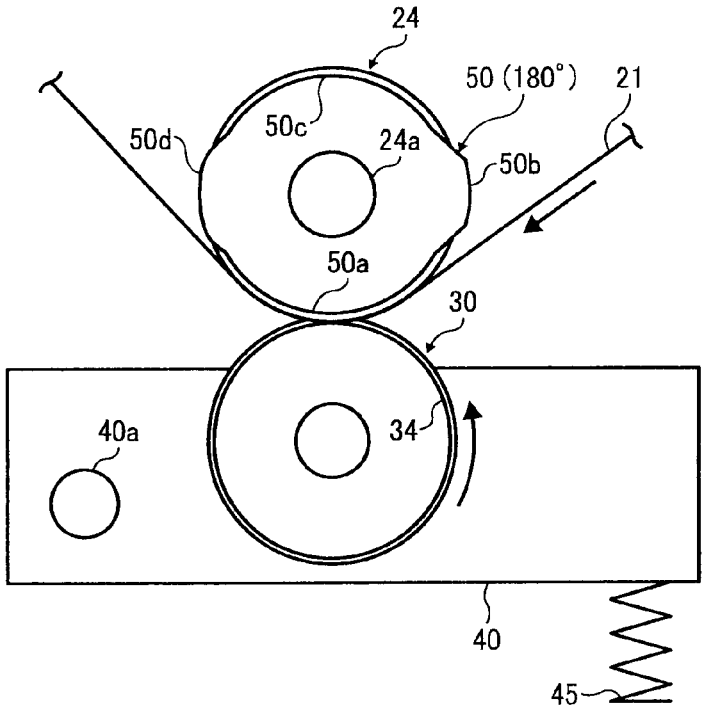
FIG. 8 is a diagram showing the peripheral configuration of the secondary transfer position in a condition in which the first rotating cam is stopped at a rotational angle position of 180[°]

FIG. 8 shows the periphery of the secondary transfer position in a condition in which the first rotating cam 50 is normally rotated by 90[°] from the condition shown in FIG. 7, that is, a condition in which the first rotating cam 50 is stopped at a rotational angle position of 180[°]. In this condition, the first small-diameter part 50*a* of the first rotating cam 50 is positioned to face the first spin roller 34 on the shaft member of the secondary transfer roller 30, in a non-contact manner. In other words, as with the case where the first rotating cam 50 is at a rotational angle position of 0[°], the first rotating cam 50 does not push down the secondary transfer roller 30, and the secondary transfer roller 30 is pressed against the intermediate transfer belt 21 by the biasing force of the bias coil spring 45, whereby the secondary transfer nip is formed.

Figure 9:
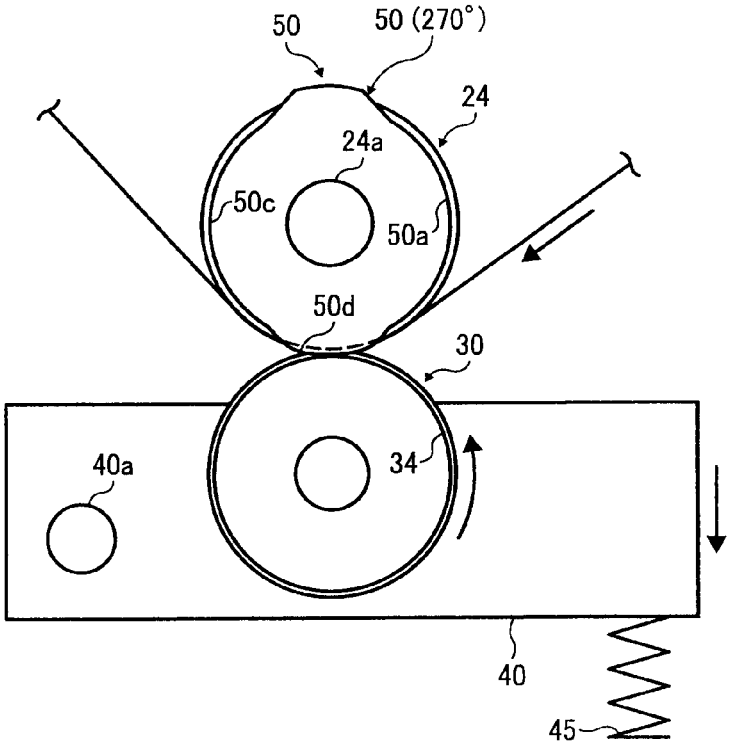
FIG. 9 is a diagram showing the peripheral configuration of the secondary transfer position in a condition in which the first rotating cam is stopped at a rotational angle position of 270[°]

FIG. 9 shows the periphery of the secondary transfer position in a condition in which the first rotating cam 50 is normally rotated by 90[°] from the condition shown in FIG. 8, that is, a condition in which the first rotating cam 50 is stopped at a rotational angle position of 270[°]. In this condition, the first rotating cam 50 causes the second convex part 50*d* to abut on the first spinning roller 34 on the shaft member of the secondary transfer roller 30 to push down the secondary transfer roller 30. When the secondary transfer roller 30 is pushed down by the second convex part 50*d*, the secondary transfer roller 30 comes into line contact (soft touch) with the intermediate transfer belt 21, as shown in the diagram. The pressing force becomes weaker than when the wide secondary transfer nip is formed.

Figure 10:
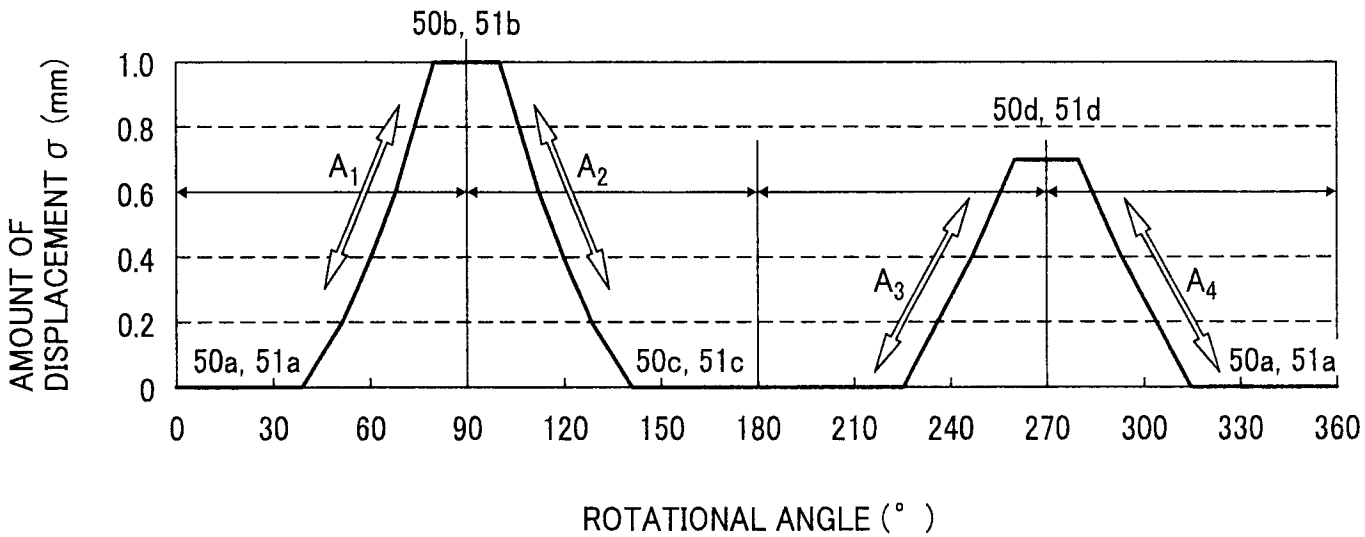
FIG. 10 is a graph showing the relationship between the rotational angle position of each of the rotating cams (first and second) and the amount of displacement δ of the same.

FIG. 10 is a graph showing the relationship between the rotational angle position of each of the rotating cams (50, 51) and the amount of displacement δ of the same. As shown in the diagram, because the rotating cam does not push down the secondary transfer roller when the rotational angle position is 0[°] or 180[°], the amount of displacement δ (=push-down amount) is 0 [mm]. However, when the rotational angle position of the rotating cam is 90[°], the amount of displacement δ is 1 [mm]. This amount 1 [mm] is equal to the difference in level between the first or second small-diameter part of the rotating cam and the first convex part. Moreover, when the rotational angle position of the rotating cam is 270[°], the amount of displacement δ is 0.7 [mm]. This amount 0.7 [mm] is equal to the difference in level between the first or second small-diameter part of the rotating cam and the second convex part.

When the controller executes the forced movement process described above, the controller alternately executes a first forced movement process for normally driving and rotating the rotating cam (50, 51) to a predetermined rotational angle position of 90[°] or 270[°], and a second forced movement process for inversely driving and rotating the rotating cam to a rotational angle position of 90[°] or 270[°]. More specifically, the controller alternately executes the first forced movement process and the second forced movement process when pushing down the secondary transfer roller (a rotational angle position of 90[°]) by using the first convex part (50*b*, 51*b*). Further, the controller alternately executes the first force movement and the second forced movement when pushing down the secondary transfer roller (a rotational angle position of 270[°]) by using the second convex part (50*d*, 51*d*).

As described above, the controller executes the forced movement process not only at the pre-entry timing but also at the timing immediately prior to the discharge. This forced movement process is particularly referred to as "decompression process" as mentioned above, but the decompression process by the first force movement process is particularly referred to as "first decompression process." The decompression process by the second forced movement process is referred to as "second decompression process."

As shown in FIG. 7 previously, the condition in which the secondary transfer roller 30 is pushed down by the first convex part 50*b* (a rotational angle position of 90[°]) is a second condition in which the first convex part 50*b* abuts on the circumferential surface of the first spinning roller 34 functioning as the part to be abutted. There are two methods for changing the condition where the secondary transfer roller 30 is not pushed down, to the second condition.

The first method is a method for changing the condition shown in FIG. 6 to the second condition shown in FIG. 7, by normally rotating the first rotating cam by 90[°]. This is performed by the first forced movement process because the rotating cam is normally rotated. In this first forced movement process, a first condition in which the second small-diameter part 50*c* functioning as the upstream side small-diameter part in relation to the first convex part 50*b* of the first rotating cam 50 is positioned to face the first spinning roller 34 in a non-contact state is changed to the second condition in which the first rotating cam 50 is normally driven to rotate to cause the first convex part 50*b* of the first rotating cam 50 to abut on the first spinning roller 34.

The second method is a method for changing the condition shown in FIG. 8 to the second condition shown in FIG. 7, by inversely rotating the first rotating cam by 90[°]. This is performed by the second forced movement process because the rotating cam is inversely rotated. In this second forced movement process, a third condition in which the first small-diameter part 50*a* functioning as the downstream side small-diameter part in relation to the first convex part 50*b* of the first rotating cam 50 is positioned to face the first spinning roller 34 in a non-contact state is changed to the second condition in which the first rotating cam 50 is inversely driven to rotate to cause the first convex part 50*b* of the first rotating cam 50 to abut on the first spinning roller 34.

When performing the forced movement process for changing the condition to the second condition shown in FIG. 7, the controller alternately executes the first forced movement process for changing the condition shown in FIG. 6 to the second condition shown in FIG. 7 by normally rotating the first rotating cam 50 by 90[°], and the second forced movement process for changing the condition shown in FIG. 8 to the second condition shown in FIG. 7 by inversely rotating the first rotating cam 50 by 90[°]. More specifically, first of all, prior to the forced movement process, the controller checks whether the current condition is the condition shown in FIG. 6 or the condition shown in FIG. 8. When the current condition is the condition shown in FIG. 6, which is the first condition with respect to the first convex part 50*b*, the first forced movement process is executed by normally rotating the cam by 90[°] at the pre-entry timing mentioned above, and this condition is changed to the second condition shown in FIG. 7. Thereafter, when the timing immediately after the entry arrives by allowing the front edge of the sheet to enter between the intermediate transfer belt 21 and the secondary transfer roller 30, the first rotating cam 50 is normally rotated by 90[°], and this condition is changed to the third condition shown in FIG. 8 in which the first small-diameter part 50*a* functioning as the downstream side small-diameter part in relation to the first convex part 50*b* is positioned to face the first spinning roller 34 in non-contact state. When the timing immediately prior to the discharge at which the rear edge of the recording sheet slips out of the space between the intermediate transfer belt 21 and the secondary transfer roller 30 arrives, the second forced movement process (=second decompression process) is executed by inversely rotating the cam by 90[°], to change the condition to the second condition shown in FIG. 7. In this manner, the first forced movement process and the second forced movement process are executed alternately.

On the other hand, when the condition prior to the execution of the forced movement process is the condition shown in FIG. 8, that is, when the condition is the third condition with respect to the first convex part 50*b*, the second forced movement process is executed by inversely rotating the cam by 90[°] at the pre-entry timing mentioned above, and the condition is changed to the second condition shown in FIG. 7. Thereafter, when the timing immediately after the entry arrives by allowing the front edge of the sheet to enter between the intermediate transfer belt 21 and the secondary transfer roller 30, the first rotating cam 50 is inversely rotated by 90[°], and the condition is changed to the first condition shown in FIG. 6 in which the second small-diameter part 50*c* functioning as the upstream side small-diameter part in relation to the first convex part 50*b* is positioned to face the first spinning roller 34 in a non-contact state. When the timing immediately prior to the discharge arrives, the first forced movement process (=first decompression process) is executed by normally rotating the cam by 90[°], to change the condition to the second condition shown in FIG. 7. In this manner, the first forced movement process and the second forced movement process are executed alternately.

Figure 11:
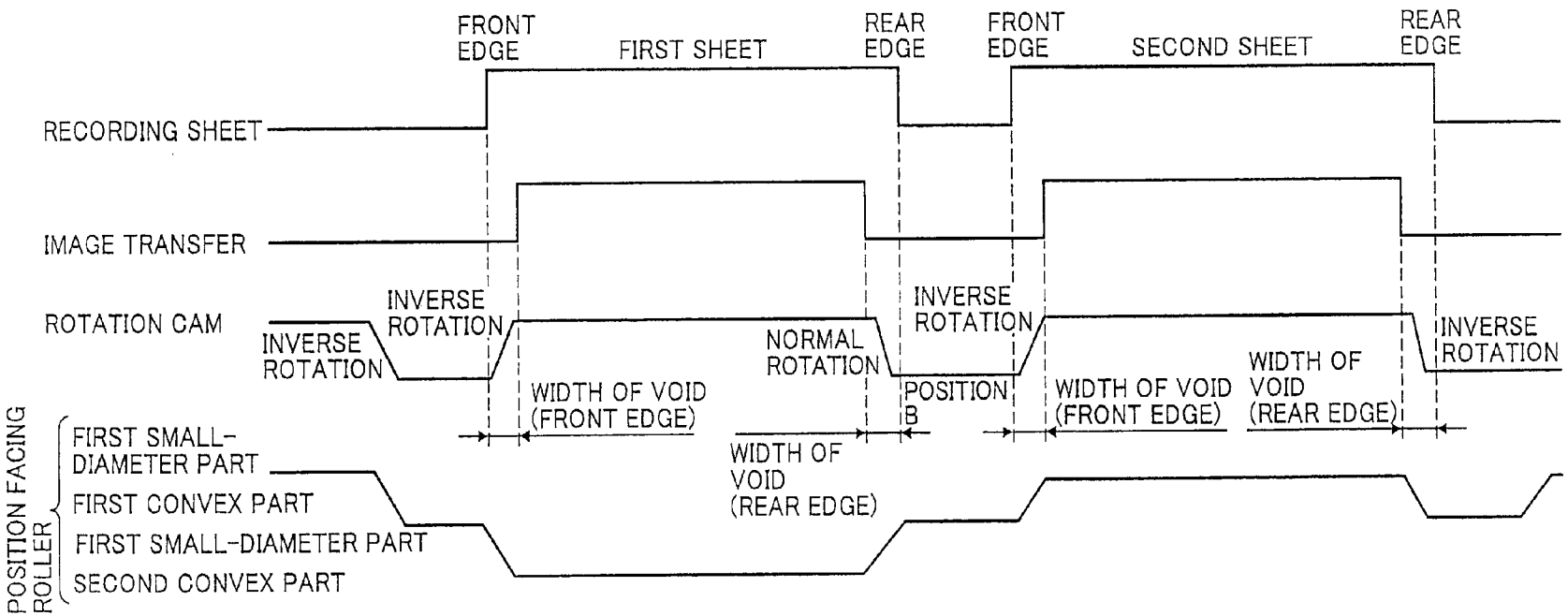
FIG. 11 is a timing chart showing various timings when performing on a plurality of recording sheets a forced movement process using a first convex part, a pressure intensifying process, and a decompression process using the first convex part in a continuous printing mode.

FIG. 11 shows various timings when a plurality of recording sheets are subjected to the forced movement process using the first convex part, the pressure intensifying process, and the decompression process using the first convex part in a continuous printing mode. As shown in the diagram, by appropriately carrying out the operations described above, the first forced movement process and the second forced movement process can be alternately performed on the first convex part, even in the continuous printing mode. Similarly in the forced movement process using the second convex part as well, the processes can be performed alternately in the continuous printing mode.

Note in the diagram that the distance between the front edge of each recording sheet and the front edge of the toner image, which is the width of edge void, is only approximately 4 [mm]. Therefore, high-speed cam rotation is required.

In the present copy machine, not only the condition shown in FIG. 7 but also the condition shown in FIG. 9 is changed to the second condition. This is because the second convex part 50*d* is caused to abut on the circumferential surface of the first spinning roller 34 functioning as the part to be abutted. There are also two methods for changing the condition in which the secondary transfer roller 30 is not pushed down, to the second condition shown in FIG. 9.

The first method is a method for changing the condition shown in FIG. 8 to the second condition shown in FIG. 9 by normally rotating the first rotating cam by 90[°]. This is performed by the first forced movement process because the rotating cam is normally rotated. In this first forced movement process, a first condition in which the first small-diameter part 50*a* functioning as the upstream side small-diameter part in relation to the second convex part 50*d* of the first rotating cam 50 is positioned to face the first spinning roller 34 in a non-contact state is changed to the second condition in which the first rotating cam 50 is normally driven to rotate to cause the second convex part 50*d* of the first rotating cam 50 to abut on the first spinning roller 34.

The second method is a method for changing the condition shown in FIG. 6 to the second condition shown in FIG. 9 by inversely rotating the first cam by 90[°]. This is performed by the second forced movement process because the rotating cam is inversely rotated. In this second forced movement process, a third condition in which the second small-diameter part 50*c* functioning as the downstream side small-diameter part in relation to the second convex part 50*d* of the first rotating cam 50 is positioned to face the first spinning roller 34 in a non-contact state is changed to the second condition in which the first rotating cam 50 is inversely driven to rotate to cause the second convex part 50*d* of the first rotating cam 50 to abut on the first spinning roller 34.

When performing the forced movement process for changing the condition to the second condition shown in FIG. 9, the controller alternately executes the first forced movement process for changing the condition shown in FIG. 8 to the second condition shown in FIG. 9 by normally rotating the first rotating cam 50 by 90[°], and the second forced movement process for changing the condition shown in FIG. 6 to the second condition shown in FIG. 9 by inversely rotating the first rotating cam 50 by 90[°]. More specifically, first of all, prior to the forced movement process, the controller checks whether the current condition is the condition shown in FIG. 8 or the condition shown in FIG. 6. When the current condition is the condition shown in FIG. 8, which is the first condition with respect to the second convex part 50*d*, the first forced movement process is executed by normally rotating the cam by 90[°] at the pre-entry timing mentioned above, and this condition is changed to the second condition shown in FIG. 9. Thereafter, when the timing immediately after the entry arrives, the first rotating cam 50 is normally rotated by 90[°], and this condition is changed to the third condition shown in FIG. 6 in which the second small-diameter part 50*c* functioning as the downstream side small-diameter part in relation to the second convex part 50*d* is positioned to face the first spinning roller 34 in non-contact state. When the timing immediately prior to the discharge arrives, the second forced movement process (=second decompression process) is executed by inversely rotating the cam by 90[°], to change the condition to the second condition shown in FIG. 9. In this manner, the first forced movement process and the second forced movement process are executed alternately.

On the other hand, when the condition in FIG. 6 prior to the execution of the forced movement process is the condition in FIG. 9, that is, when the condition is the third condition with respect to the second convex part 50*d*, the second forced movement process is executed by inversely rotating the cam by 90[°] at the pre-entry timing mentioned above, and the condition is changed to the second condition shown in FIG. 9. Thereafter, when the timing immediately after the entry arrives, the first rotating cam 50 is inversely rotated by 90[°], and the condition is changed to the first condition shown in FIG. 8 in which the first small-diameter part 50*a* functioning as the upstream side small-diameter part in relation to the second convex part 50*d* is positioned to face the first spinning roller 34 in a non-contact state. When the timing immediately prior to the discharge arrives, the first forced movement process (=first decompression process) is executed by normally rotating the cam by 90[°], to change the condition to the second condition shown in FIG. 9. In this manner, the first forced movement process and the second forced movement process are executed alternately.

In FIG. 5 described previously, the rotating cam (50, 51) wears out the first convex part (50*b*, 51*b*) or second convex part (50*d*, 51*d*) mainly during the forced movement process rather than the pressure intensifying process. The convex parts become worn out very little during the pressure intensifying process. This is because although the convex part becomes worn out when the spinning roller is pushed in by the convex part against the biasing force of the bias coil spring, the convex part is not rubbed much when the convex part rollers back along the biasing force of the bias coil spring.

When carrying out the first forced movement process in which the first convex part 50*b*, 51*b* is caused to abut on the spinning roller (34, 35) by normally rotating the rotating cam, mainly half of the region on the upstream side (region $A_1$) in the normal rotation direction of the first convex part 50*b*, 51*b* becomes worn out. When, on the other hand, performing the second forced movement process in which the first convex part 50*b*, 51*b* is caused to abut on the spinning roller (34, 35) by inversely rotating the rotating cam, mainly half of the region on the downstream side (region $A_2$) in the normal rotation direction of the first convex part 50*b*, 51*b* becomes worn out. In the present copy machine, by switching between the first forced movement process for normally rotating the rotating cam (50, 51) and the second forced movement process for inversely rotating the rotating cam to execute the forced movement process, the worn-out region of the first convex part 50*b*, 51*b* is dispersed to the region $A_1$ and the region $A_2$. In this manner, the life of the rotating cam (50, 51) can be increased. Regarding the second convex part 50*d*, 51*d* as well, the worn-out region thereof can be similarly dispersed to a region $A_3$ and region $A_4$ to increase the life of the rotating cam (50, 51).

The inventors have prepared a copy test machine having the same configuration as the copy machine according to the present embodiment. The inventors have conducted the following first print test using this copy test machine. In other words, the inventors have output a predetermined test image onto recording sheets. In the forced movement process carried out at the timing immediately prior to the entry or the forced movement process (decompression process) carried out at the timing immediately prior to the discharge, the first convex part (50*b*, 51*b*) of the rotating cam (50, 51) is caused to abut on the spinning roller (34, 35) to push down the secondary transfer roller 30 by 1 [mm]. A thick sheet $P_2$ having a basis weight of 160 [g/m$^2$] and a thickness of approximately 160 [μm], and a super-thick sheet $P_3$ having a basis weight of 300 [g/m$^2$] and a thickness of approximately 320 [μm] are used as the recording sheets. During a print job, the speed of the intermediate transfer belt 21 was measured using an optical image sensor.

Figure 12:
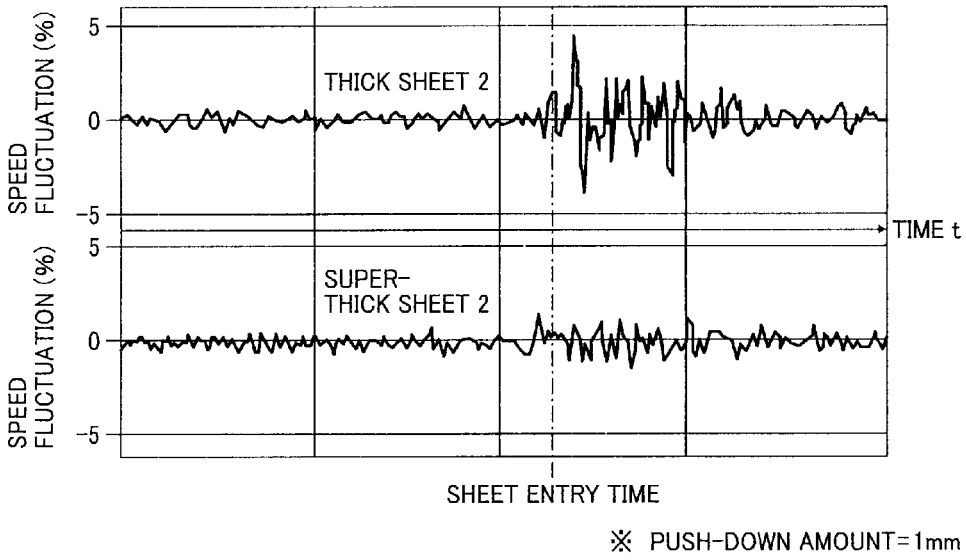
FIG. 12 is a graph showing the relationship between the speed variation of an intermediate transfer belt and an elapsed time in a first print test (push-down amount=1 mm)

FIG. 12 is a graph showing the relationship between the speed variation of an intermediate transfer belt 21 and an elapsed time in the first print test. When using either the thick sheet $P_2$ or the super-thick sheet $P_3$, the fluctuation of the speed of the belt at the time of the entry of the sheet was somewhat eliminated by pushing down the secondary transfer roller 30 in the forced movement process prior to the time of the entry of the sheet (the time at which a front edge of the recording sheet enters the secondary transfer position. However, when the thick sheet $P_2$ was used, the speed of the belt has significantly fluctuated immediately after the entry of the sheet. This is as a result of a drastic increase of the burden on the intermediate transfer belt 21, which is caused by canceling the push-down motion of the secondary transfer roller 30 at once during the pressure intensifying process executed at the timing immediately after the entry. By slowly rotating the rotating cam while gradually canceling the push-down motion, the speed of the belt can be prevented from fluctuating. However, this reduces the transfer pressure in the vicinity of the front edge of the sheet. For this reason, it is desired to not rotate the rotating cam slowly in the decompression process.

When the super-thick sheet $P_3$ is used, the speed of the belt does not change much in the pressure intensifying process. The reason is as follows. In other words, when the super-thick sheet $P_3$ is used, even if the push-down motion of the secondary transfer roller 30 is canceled at once, the secondary transfer roller 30 returns in the spring biasing direction by only a small distance, due to the great thickness of the super-thick sheet $P_3$. For this reason, the burden on the intermediate transfer belt 21 does not increase drastically.

Although the pressure intensifying process was omitted, another test print was carried out under the similar conditions. However, a sufficient image density was not obtained.

Figure 13:
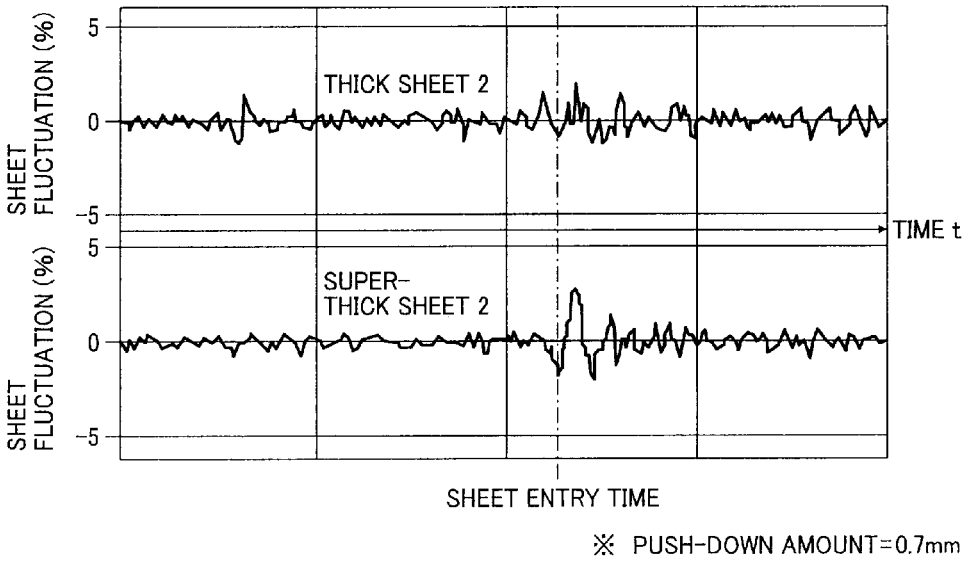
FIG. 13 is a graph showing the relationship between the speed variation of the intermediate transfer belt and an elapsed time in a second print test (push-down amount=0.7 mm)

Next, the inventors have reduced the push-down amount of the secondary transfer roller 30 to 0.7 [mm], and carried out a second print test under the same conditions as the first print test. FIG. 13 is a graph showing the relationship between the speed variation of the intermediate transfer belt 21 and an elapsed time in the second print test. When using either the thick sheet $P_2$ or the super-thick sheet $P_3$, the speed of the belt did not fluctuate much at the moment when the pressure intensifying process was carried out. However, when the super-thick sheet $P_3$ was used, the speed of the belt has fluctuated significantly at the time of the entry of the sheet. This is because when the super-thick sheet $P_3$ was used and the push-down amount was 0.7 [mm], the occurrence of a shock jitter could not be prevented enough.

Although the pressure intensifying process was omitted, another test print was carried out under the similar conditions. In this case, a slight decrease in the image density was confirmed, though it was within an allowance.

The facts described above prove that the appropriate value of the push-down amount varies between the thick sheet $P_2$ and the super-thick sheet $P_3$.

The present copy machine, therefore, is provided with thickness information acquisition means for acquiring thickness information of a recording sheet supplied to the secondary transfer nip. A thickness detection sensor for actually detecting the thickness of the recording sheet conveyed through the sheet feeding path 99, or data input means for receiving a data input of the thickness information from an operator may be used as the thickness information acquisition means. Examples of the thickness detection sensor include an optical sensor for detecting a light transmittance in a thickness direction, and a sensor for detecting the amount of movement of a conveying roller pair when a recording sheet is sandwiched by the roller pair.

The controller adjusts the push-down amount of the secondary transfer roller 30 in response to an acquisition result obtained by the thickness information acquisition information. Specifically, a ROM or other data storage means of the controller stores a data table in which the thickness of the recording sheets is associated with the rotational angle positions (push-down position) of the rotating cam corresponding to the thickness of the recording sheet. The rotational angle position corresponding to the thickness of a recording sheet is specified from the data table, and the rotating cam is rotated to the position described in the specified result during the forced movement process or decompression process before the entry. According to such a configuration, setting the push-down amount appropriately in relation to the thickness of the recording sheet can prevent the occurrence of a shock jitter at the time of the entry of the sheet, the fluctuation of the speed of the belt when the pressure intensifying process is carried out immediately after the entry, and the fluctuation of the speed of the belt when discharging the sheet.

In the abovementioned data table, two values of 0[°] and 180[°] are associated as the rotational angle positions in relation to the range of the thickness of a standard sheet $P_1$. Thus, in the case of the standard sheet $P_1$, the forced movement process, pressure intensifying process and decompression process are not carried out at the time of the entry of the sheet. This is because when the relatively thin standard sheet $P_1$ is used, even when the secondary transfer roller 30 is not pushed down, the burden on the belt or secondary transfer roller 30 does not fluctuate significantly when this sheet enters the secondary transfer nip. In addition, in the data table a value 270[°] is associated as the rotational angle position in relation to the range of the thickness of the thick sheet $P_2$. Also, a value 90[°] is associated as the rotational position in relation to the range of the thickness of the super-thick sheet $P_3$.

The controller is configured to recognize the stop position of the rotation of the penetrating shaft member 24*a*, based on, as explained above, the timing at which the optical sensor 60 detects the part 59*a* to be detected in the disc 59 to be detected, or how much a stepping motor functioning as the cam driving motor 58 is driven from the timing.

Figure 14:
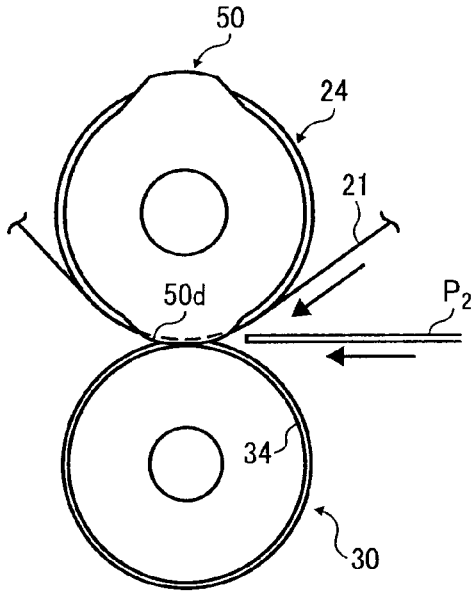
FIG. 14 is a side view showing a condition of the secondary transfer position obtained at a pre-entry timing of a thick sheet $P_2$.

FIG. 14 shows a condition of the secondary transfer position obtained at the pre-entry timing of the thick sheet $P_2$. As shown in the diagram, when using the thick sheet $P_2$, a process for causing the second convex part 50*d* of the first rotating cam 50 to abut on the first spinning roller 34 is executed as the forced movement process at the pre-entry timing. Consequently, the occurrence of a shock jitter at the time of the entry of the sheet can be prevented.

Figure 15:
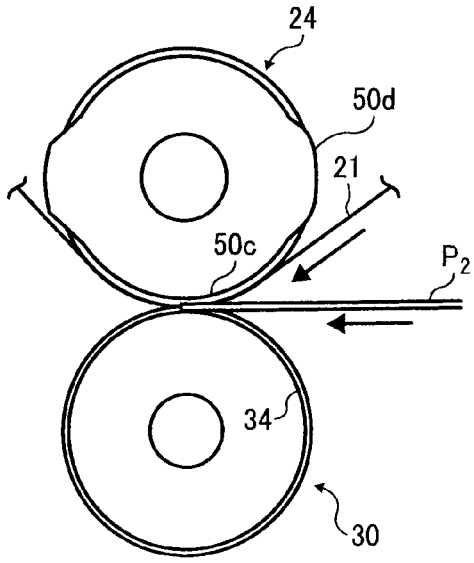
FIG. 15 is a side view showing an example of a condition of the secondary transfer position obtained at a timing immediately after the entry of the thick sheet $P_2$.

FIG. 15 shows an example of a condition of the secondary transfer position obtained at the timing immediately after the entry of the thick sheet $P_2$. Even when the pressure intensifying process is executed at the timing immediately after the entry, to cancel the push-down motion of the secondary transfer roller 30 at once, the fluctuation of the speed of the belt can be prevented from occurring, because the push-down amount that is obtained immediately prior to the cancellation depends on the second convex part 50*d* and is appropriate for the thick sheet $P_2$. Although this diagram show an example in which the second small-diameter part 50*c* is positioned in a region facing the first spinning roller 34, the first small-diameter part 50*a* may be positioned in the region facing the first spinning roller 34.

Figure 16:
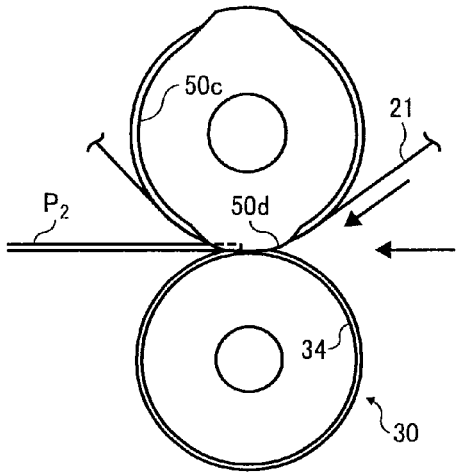
FIG. 16 is a side view showing an example of a condition of the secondary transfer position obtained at a timing immediately prior to the discharge of the thick sheet $P_2$.

FIG. 16 shows an example of a condition of the secondary transfer position obtained at the timing immediately prior to the discharge of the thick sheet $P_2$. As shown in the diagram, when using the thick sheet $P_2$ a process for causing the second convex part 50*d* of the first rotating cam 50 to abut on the first spinning roller 34 is executed as the decompression process at the timing immediately prior to the discharge. As a result, the fluctuation of the speed of the belt at the time of the discharge of the sheet can be prevented. Although this diagram shows an example in which the second small-diameter part 50*c* is positioned in a region facing the first spinning roller 34, the first small-diameter part 50*a* may be position in the region facing the first spinning roller 34.

When using the super-thick sheet $P_3$, pushing down is performed by the first convex part 50*b* in place of the second convex part 50*d*.

In the process of causing the rotating cam (50, 51) of the secondary transfer counter roller 24 to abut on the spinning roller (34, 35) of the secondary transfer roller 30, when secondary transfer current leaks from the former roller to the latter roller through this abutting part, the secondary transfer electric field with an appropriate strength cannot be formed in the secondary transfer nip. Therefore, at least one of the rotating cam or the spinning roller is preferably configured by an insulating material. In the present copy machine, the rotating cam (50, 51) is made from an insulating material called polyacetal resin in order to prevent the occurrence of the leakage.

The spinning roller (34, 35) may be configured by a resin. However, it is preferred that the spinning roller be configured by a highly rigid material so that the rotating cam (50, 51) is not deformed by pressure. In the copy machine, the spinning roller is configured by a metallic ball bearing. Such spinning roller is not deformed by the pressure of the rotating cam and does not affect the accuracy of the rotation position of the secondary transfer roller 30. In addition, such spinning roller has excellent slidability and thus is capable of reducing the wearing of the rotating cam.

Figure 17:
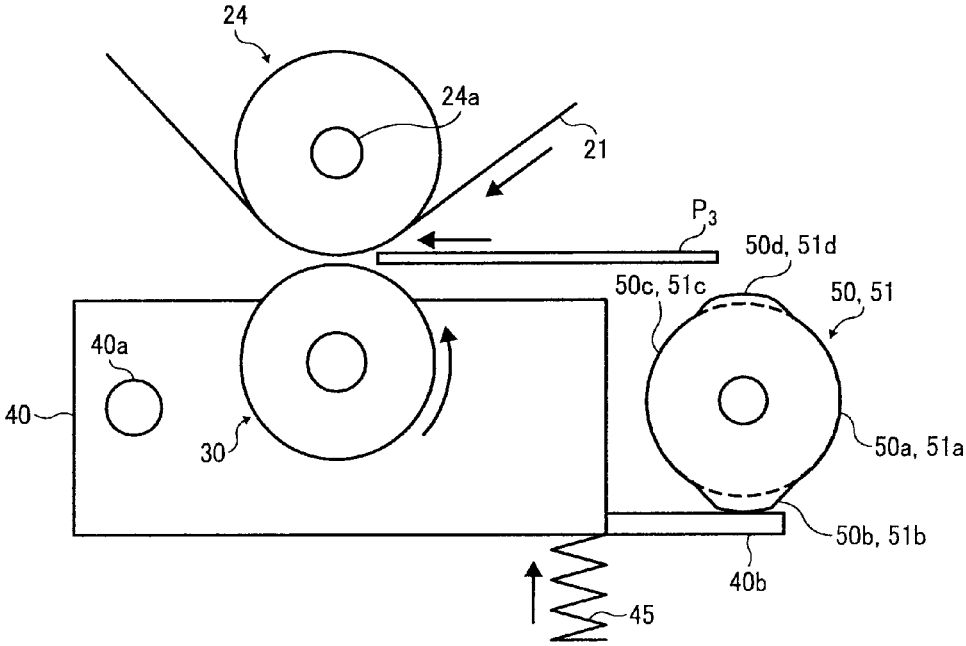
FIG. 17 is a configuration diagram showing the peripheral configuration of a secondary transfer position in a modification of the copy machine according to the present embodiment.

FIG. 17 shows the periphery of the secondary transfer position in a modification of the copy machine according to the present embodiment. In the copy machine according to the modification, the first rotating cam 50 and the second rotating cam 51 are provided to a special rotating a rotation shaft member instead of the penetrating shaft member 24*a* of the secondary transfer counter roller 24. The secondary transfer roller 30 is pushed down by bringing the first rotating cam 50 and the second rotating cam 51 into abutment with a part 40*b* to be abutted, which is provided to the roller unit holding body 40 functioning as an interlocking body. In this manner, the rotating cams may be brought into abutment with, not the spinning roller, but another interlocking body that interlocks the secondary transfer roller 30 with a biasing movement generated by the bias coil spring 45. The rotating cams may also be brought into abutment with the secondary transfer roller 30 itself.

The above has described the copy machine that uses, as an image carrier, the endless intermediate transfer belt 21 that is wrapped around the rotatable secondary transfer counter roller 24 and moved endlessly. However, the present invention can be applied to a combination of another image carrier and abutting body.

Instead of biasing the abutting body to the image carrier, the image carrier may be biased to the abutting body, and the image carrier may be pushed down by means of the rotating cam. In addition, the above has described the example of causing the small-diameter part of the rotating cam to face the spinning roller and canceling the push-down motion, but the secondary transfer roller may be pushed down by the small-diameter part at a push-down amount smaller than that of the convex part.

As described above, in the copy machine according to the present embodiment, the rotating cam (50, 51) has, as the small-diameter parts, the upstream side small-diameter part adjacent to the convex part on the upstream side in the normal rotation direction of the rotating cam, and the downstream side small-diameter part adjacent to the convex part on the downstream side. The controller executes the process for changing the first condition in which the upstream side small-diameter part of the rotating cam is caused to face the circumferential surface (part to be abutted) of the spinning roller in non-contact state, to the second condition in which the convex part of the rotating cam is brought into abutment with the circumferential surface of the spinning roller. The controller at the same time executes the second forced movement process for changing the third condition in which the downstream side small-diameter part of the rotating cam is caused to face the circumferential surface of the spinning roller in a non-contact state, to the second condition by inversely driving and rotating the rotating cam. In this manner, the first forced movement process is made different from the second forced movement process, and both processes can be performed alternately.

In addition, in the copy machine according to the present embodiment, the controller carries out the forced movement process at not only the pre-entry timing but also the timing immediately prior to the discharge at which the rear edge of the recording sheet is discharged from the secondary transfer position. According to this configuration, the transfer pressure can be reduced immediately prior to the discharge of the sheet to prevent the occurrence of the fluctuation of the speed of the belt at the time of the discharge, as described above.

In the copy machine according to the present embodiment, the controller executes, at a predetermined timing, a first pressure intensifying process for changing the second condition to the third condition by normally driving and rotating the rotating cam, and a second pressure intensifying process for changing the second condition to the first condition by inversely driving the rotating the rotating cam, alternately, as the pressure intensifying process. More specifically, these processes are alternately switched and executed. By switching these processes, the first force movement process and the second forced movement process can be switched.

In addition, the copy machine according to the present embodiment has the thickness information acquisition means for acquiring the thickness information of the recording sheet to be sent to the secondary transfer position, and the rotating cam (50, 51) provided with the first convex part (50*b*, 51*b*) and the second convex part (50*d*, 51*d*) having different orbit radiuses. Then, in response to the detection result obtained by the thickness information acquisition means, the controller carries out a process for selecting, from the two convex parts, the one that is brought into abutment with the circumferential surface of the forced movement process. According to this configuration, the push-down amount is appropriately set in accordance with the thickness of the recording sheet, whereby the occurrence of a shock jitter at the pre-entry timing, the fluctuation of the speed of the belt at the time of the execution of the pressure intensifying process, and the fluctuation of the speed of the belt at the time of the discharge of the recording sheet can be prevented, as described above.

The copy machine according to the present embodiment further has predetermined rotational angle position detection means for detecting that the rotating cam (50, 51) is brought to a predetermined rotating angle position, the predetermined rotational angle position detection means being configured by the disc 59 to be detected, the optical sensor 60, and the like. In the forced movement process, the controller stops the rotary drive of the cam driving motor 58 functioning as a drive source of the rotating cam (50, 51), based on the detection result obtained by the predetermined rotational angle position detection means. According to this configuration, the rotating cam can reliably be stopped at a desired rotational angle position.

Note that a stepping motor is used as the cam driving motor 58 functioning as a rotary drive source of the rotating cam. Therefore, the rotation of the rotating cam can be stopped accurately.

The effects of the present invention are described hereinbelow.

(1) The forced movement process is executed at the pre-entry timing to forcibly move the abutting body away from the image carrier, whereby a drastic increase in the burden on the image carrier that is caused at the time of the entry of a sheet can be prevented. As a result, the occurrence of a shock jitter can be inhibited.

(2) The pressure intensifying process is executed at the timing immediately after the entry, to make the transfer pressure higher than that obtained at the pre-entry timing, whereby a sufficient transfer pressure is obtained during the transfer process. As a result, transfer failures can be prevented from occurring.

(3) Additionally, the life of the rotating cam can be increased for the following reasons. Specifically, the top of the convex part of the rotating cam is generally formed into a convex curved surface in order to improve the slidability with the part to be abutted. In the forced movement process, the central section of the convex curved surface in the cam rotation direction is brought into abutment with the part to be abutted as the cam rotates. In so doing, the part to be abutted is pressed in a normal direction while strongly rubbing half of the region on the upstream side in the rotation direction of the central section against the part to be abutted. Thus, the convex part becomes worn out at this half region on the upstream side in the rotation direction of the convex curved surface. In the conventional apparatus, the rotating cam is rotated in the normal rotation direction only, whereby half of the region on the upstream side in the normal rotation direction of the convex curved surface becomes worn out intensively. In the present invention, on the other hand, the rotation direction of the rotating cam is switched between the normal rotation direction and the inverse rotation direction when carrying out the forced movement process, so that the wear of the convex curved surface is dispersed to the half region on the upstream side in the normal rotation direction and the half region on the downstream side in the normal rotation direction (=half region on the upstream side in the inverse rotation direction). As a result, the life of the rotating cam can be increased.

Various modifications will become possible for those skilled in the art after receiving the teachings of the present disclosure without departing from the scope thereof.

What is claimed is:

1. An image forming apparatus, comprising:

an image carrier that carries a visual image;

an abutting body that is capable of abutting on the image carrier at a transfer position where the abutting body faces the image carrier, and forming a transfer nip;

a transfer part that transfers to a recording sheet that enters the transfer position, the visual image on the image carrier;

a rotating cam that is disposed so as to be able to rotate both normally and inversely and has a plurality of convex parts provided at a circumferential edge of the rotating cam and a small-diameter part that rotates on an orbit, the radius of which is smaller than that of the convex parts, a first convex part of the plurality of the convex parts having a different orbit radius than a second convex part of the plurality of convex parts; and a part to be abutted, which is provided to one of the image carrier and the abutting body, and which is brought into abutment with the rotating cam.

2. The image forming apparatus as claimed in claim 1, further comprising a biasing part for biasing abutting one of the image carrier and the abutting body to the other one of the image carrier and the abutting body.

3. The image forming apparatus as claimed in claim 2, wherein the rotating cam is capable of performing a forced movement operation for forcibly moving one of the image carrier and the abutting body away from the other one of the image carrier and the abutting body against a biasing force of the biasing part by bringing the convex parts into abutment with the part to be abutted at a predetermined rotational angle position, and is also capable of performing a pressure intensifying operation for increasing transfer pressure on the recording sheet at the transfer position, by bringing the small-diameter part into abutment with the part to be abutted at another rotational angle position, to reduce an amount of forced movement of one of the image carrier and the abutting body, or by causing the small-diameter part to face the part to be abutted, in a non-contact state, to cancel the forced movement of one of the image carrier and the abutting body.

4. The image forming apparatus as claimed in claim 3, further comprising a controller that executes a forced movement process for rotating the rotating cam to the predetermined rotational angle position to forcibly move one of the image carrier and the abutting body at a pre-entry timing, which is a timing prior to entry of a front edge of the recording sheet into the transfer position, and a pressure intensifying process for rotating the rotating cam to the other rotational angle position to increase the transfer pressure at a timing immediately after the entry, which is a timing immediately after the entry of the front edge of the recording sheet into the transfer position.

5. The image forming apparatus as claimed in claim 4, wherein, as the forced movement process, the controller executes, alternately, a first forced movement process for rotating the rotating cam to the predetermined rotational angle position by normally driving and rotating the rotating cam, and a second forced movement process for rotating the rotating cam to the predetermined rotational angle position by inversely driving and rotating the rotating cam, at a predetermined timing.

6. The image forming apparatus as claimed in claim 5, wherein the rotating cam has, as the small-diameter part, an upstream side small-diameter part that is adjacent to the convex parts on an upstream side, in a normal rotation direction, of the rotating cam, and a downstream side small-diameter part that is adjacent to the convex part on a downstream side, and wherein the controller executes, as the first forced movement process, a process for changing a first condition in which the upstream side small-diameter part of the rotating cam is brought into abutment with the part to be abutted or caused to face the part to be abutted in a non-contact state, to a second condition in which the first or second convex part of the rotating cam is brought into abutment with the part to be abutted, by normally driving and rotating the rotating cam, and the controller further executes, as the second forced movement process, a process for changing a third condition in which the downstream side small-diameter part of the rotating cam is brought into abutment with the part to be abutted or caused to face the part to be abutted in a non-contact state, to the second condition by inversely driving and rotating the rotating cam.

7. The image forming apparatus as claimed in claim 6, wherein the controller executes the forced movement process at not only the pre-entry timing but also at a timing immediately prior to the discharge, which is a timing immediately prior to the discharge of a rear edge of a recording sheet from the transfer position.

8. The image forming apparatus as claimed in claim 6, wherein, as the pressure intensifying process, the controller executes, alternately, a first pressure intensifying process for changing the second condition to the third condition by normally driving and rotating the rotating cam, and a second pressure intensifying process for changing the second condition to the first condition by inversely driving and rotating the rotating cam, at a predetermined timing.

9. The image forming apparatus as claimed in claim 8, wherein the controller executes the second forced movement process as the forced movement process to be carried out subsequent to the first pressure intensifying process, and further executes the first forced movement process as the forced movement process to be carried out subsequent to the second pressure intensifying process.

10. The image forming apparatus as claimed in claim 5, wherein the convex parts of the rotating cam is symmetrical with respect to a plane extending through a middle of the convex parts and a center of rotation of the cam.

11. The image forming apparatus as claimed in claim 5, further comprising:

a thickness information acquisition part for acquiring information on a thickness of a recording sheet to be sent to the transfer position, wherein the controller executes a process for selecting, from the plurality of the convex parts, a convex part that abuts on the part to be abutted in the forced movement process, in response to a detection result obtained by the thickness information acquisition part.

12. The image forming apparatus as claimed in claim 5, further comprising a predetermined rotational angle position detection part for detecting that the rotating cam is brought to the predetermined rotational angle position, wherein the controller stops rotary drive of the rotating cam based on a detection result obtained by the predetermined rotational angle position detection part, in the forced movement process.

13. The image forming apparatus as claimed in claim 5, further comprising a stepping motor as a rotary drive source of the rotating cam.

14. The image forming apparatus as claimed in claim 1, wherein the image carrier is an intermediate transfer belt, the abutting body is a secondary transfer roller, and the interlocking body is a supporting member that rotatably supports the intermediate transfer belt.

* * * * *